US008728257B2

(12) United States Patent
Oi et al.

(10) Patent No.: US 8,728,257 B2
(45) Date of Patent: May 20, 2014

(54) HIGH TENSILE STRENGTH STEEL MATERIAL HAVING EXCELLENT DELAYED FRACTURE RESISTANCE PROPERTY, AND METHOD OF MANUFACTURING THE SAME

(75) Inventors: Kenji Oi, Chiba (JP); Akihide Nagao, Kurashiki (JP); Kenji Hayashi, Kurashiki (JP)

(73) Assignee: JFE Steel Corporation, Tokyo (JP)

( * ) Notice: Subject to any disclaimer, the term of this patent is extended or adjusted under 35 U.S.C. 154(b) by 131 days.

(21) Appl. No.: 11/795,362

(22) PCT Filed: May 29, 2006

(86) PCT No.: PCT/JP2006/311157

§ 371 (c)(1),
(2), (4) Date: Jul. 16, 2007

(87) PCT Pub. No.: WO2006/129827

PCT Pub. Date: Jul. 12, 2006

(65) Prior Publication Data

US 2008/0110535 A1 May 15, 2008

(30) Foreign Application Priority Data

May 30, 2005 (JP) ..... 2005-157275
May 25, 2006 (JP) ..... 2006-145407

(51) Int. Cl.
*C21D 6/00* (2006.01)
*C21D 8/00* (2006.01)
*C21D 10/00* (2006.01)

(52) U.S. Cl.
USPC ..... 148/663; 148/622

(58) Field of Classification Search
None
See application file for complete search history.

(56) References Cited

U.S. PATENT DOCUMENTS

| | | | | |
|---|---|---|---|---|
| 5,454,883 | A * | 10/1995 | Yoshie et al. | 148/320 |
| 2004/0074573 | A1 * | 4/2004 | Funakawa et al. | 148/602 |
| 2005/0106411 | A1 * | 5/2005 | Ishikawa et al. | 428/683 |
| 2006/0144474 | A1 * | 7/2006 | Yamasaki et al. | 148/328 |
| 2006/0169366 | A1 * | 8/2006 | Yuse et al. | 148/320 |
| 2007/0029015 | A1 * | 2/2007 | Yoshinaga et al. | 148/533 |

FOREIGN PATENT DOCUMENTS

| | | | | | |
|---|---|---|---|---|---|
| EP | 1 533 392 | A1 | | 5/2005 | |
| EP | 1533392 | A1 | * | 5/2005 | C22C 38/00 |
| JP | 03-243745 | A | | 10/1991 | |
| JP | 09-279303 | A | | 10/1997 | |
| JP | 2002-212674 | A | | 7/2002 | |
| JP | 2003-073737 | A | | 3/2003 | |
| JP | 2003-239041 | A | | 8/2003 | |
| JP | 2003-253376 | A | | 9/2003 | |
| JP | 2003-321743 | A | | 11/2003 | |
| JP | 2005-068548 | A | | 3/2005 | |
| JP | 2005068548 | A | * | 3/2005 | B21B 3/00 |
| JP | 2005-105361 | A | | 4/2005 | |
| WO | WO 2004/022807 | A1 | | 3/2004 | |
| WO | WO-2004074529 | | * | 9/2004 | C22C 38/00 |
| WO | WO 2005/031024 | | * | 4/2005 | C21D 8/02 |

* cited by examiner

*Primary Examiner* — Melvin C Mayes
*Assistant Examiner* — Michael Forrest
(74) *Attorney, Agent, or Firm* — Holtz Holtz Goodman & Chick, P.C.

(57) ABSTRACT

The invention provides a high tensile strength steel material having a tensile strength of 600 MPa, which is excellent in delayed fracture resistance property, and a method of manufacturing the steel material. As means for this, a steel material contains, in mass percent, C of 0.02 to 0.25%, Si of 0.01 to 0.8%, Mn of 0.5 to 2.0%, Al of 0.005 to 0.1%, N of 0.0005 to 0.008%, P of 0.03% or less, and S of 0.03% or less. In addition, the steel material contains at least one element selected from Mo, Nb, V, and Ti, and contains at least one of Cu, Ni, Cr, W, B, Ca, REM and Mg, as needed. The remainder includes Fe and inevitable impurities. In addition, in the steel material, precipitates having an average grain size of 20 nm or less, which contains at least one of Mo, Nb, V and Ti, are contained in steel in the number of at least 5 per 250000 $nm^2$, and a microstructure includes residual austenite in a volume fraction of 0.5 to 5%. When Ca to be added is specified to be 0.0010% to 0.0020%, it is specified that S is 0.0005% to 0.0020% and O is 0.0008% to 0.0025%. ACR is specified to be $0.2 \leq ACR(=(Ca-(0.18+130*Ca)*O)/1.25/S) \leq 1.0$.

8 Claims, 1 Drawing Sheet

| | Cl 1 | C | Si | Mn | Al | N | P | S | Mo | Nb | V | Ti | Cu | Ni | Cr | W | B | Ca | REM | Mg | O | ACR |
|---|---|---|---|---|---|---|---|---|---|---|---|---|---|---|---|---|---|---|---|---|---|---|
| | min | 0.02 | 0.01 | 0.5 | 0.005 | 0.0005 | | | 0.01 | 0.001 | 0.001 | 0.001 | | | | | | | | | 0.0008 | 0.2 |
| | max | 0.25 | 0.8 | 2 | 0.1 | 0.008 | 0.03 | 0.03 | 1 | 0.1 | 0.5 | 0.1 | 2 | 4 | 2 | 2 | 0.003 | 0.01 | 0.02 | 0.01 | 0.003 | 1 |
| * | min | | | | | | | 0.0004 | 0.2 | | | | | | 0.3 | | | 0.0010 | | | | |
| * | max | | | | | | | 0.0025 | 1 | | | | | | 2 | | | 0.0030 | | | 0.003 | |

Claim 1 vs JPH9-279303

| | C | Si | Mn | Al | N | P | S | Mo | Nb | V | Ti | Cu | Ni | Cr | W | B | Ca | REM | Mg | O | ACR |
|---|---|---|---|---|---|---|---|---|---|---|---|---|---|---|---|---|---|---|---|---|---|
| A | 0.29 | 0.27 | 0.74 | 0.036 | 0.0051 | 0.008 | 0.008 | 0 | 0 | 0 | 0.012 | 0 | 0 | 0 | 0 | 0.0022 | | | | | 0 |
| B | 0.25 | 1.86 | 0.68 | 0.044 | 0.0063 | 0.006 | 0.008 | 0.23 | 0.027 | 0 | 0.008 | 0 | 0 | 0 | 0 | 0.002 | | | | | 0 |
| C | 0.11 | 0.18 | 0.72 | 0.06 | 0.0058 | 0.006 | 0.007 | 0 | 0 | 0 | 0.013 | 0 | 0 | 0 | 0 | 0.0021 | | | | | 0 |
| D | 0.3 | 0.34 | 0.76 | 0.031 | 0.0037 | 0.009 | 0.009 | 0 | 0.009 | 0 | 0.016 | 0 | 0 | 0 | 0 | 0.0012 | | | | | 0 |
| E | 0.34 | 0.07 | 0.5 | 0.028 | 0.0087 | 0.007 | 0.009 | 0 | 0 | 0.08 | 0.021 | 0 | 0.72 | 0 | 0 | 0.0024 | | | | | 0 |
| F | 0.28 | 0.13 | 1.01 | 0.026 | 0.0041 | 0.008 | 0.007 | 0 | 0.018 | 0 | 0.03 | 0 | 0 | 0.16 | 0 | 0.0036 | | | | | 0 |
| G | 0.32 | 0.54 | 0.36 | 0.023 | 0.0043 | 0.007 | 0.006 | 0 | 0.023 | 0 | 0.017 | 0 | 0 | 0 | 0 | 0.0019 | | | | | 0 |
| H | 0.21 | 0.3 | 0.9 | 0.022 | 0.0059 | 0.01 | 0.007 | 0 | 0 | 0 | 0.08 | 0.18 | 0.53 | 0 | 0 | 0.0019 | | | | | 0 |
| I | 0.34 | 0.23 | 1.91 | 0.054 | 0.006 | 0.007 | 0.01 | 0 | 0 | 0 | 0.031 | 0 | 0.36 | 0 | 0.16 | 0.002 | | | | | 0 |
| J | 0.32 | 0.11 | 0.29 | 0.031 | 0.0038 | 0.007 | 0.008 | 0 | 0.019 | 0 | 0.013 | 0 | 0.26 | 0 | 0 | 0.0024 | | | | | 0 |
| K | 0.38 | 0.09 | 0.79 | 0.037 | 0.006 | 0.008 | 0.006 | 0 | 0 | 0 | 0.021 | 0 | 0 | 0 | 0 | 0.0013 | | | | | 0 |
| L | 0.22 | 0.07 | 1.56 | 0.026 | 0.0101 | 0.007 | 0.007 | 0 | 0.012 | 0.11 | 0.011 | 0 | 0.3 | 0 | 0 | 0.0019 | | | | | 0 |
| M | 0.43 | 0.22 | 0.82 | 0.031 | 0.0059 | 0.009 | 0.008 | 0 | 0 | 0 | 0.018 | 0 | 0 | 0 | 0 | 0.0024 | | | | | 0 |
| N | 0.32 | 0.46 | 2.36 | 0.022 | 0.0039 | 0.001 | 0.008 | 0 | 0 | 0 | 0.01 | 0 | 0 | 0 | 0 | 0.0025 | | | | | 0 |

*Refers to claim 5

HIGH TENSILE STRENGTH STEEL MATERIAL HAVING EXCELLENT DELAYED FRACTURE RESISTANCE PROPERTY, AND METHOD OF MANUFACTURING THE SAME

This application is the United States national phase application of International Application PCT/JP2006/311157 filed May 29, 2006.

TECHNICAL FIELD

The present invention relates to a high tensile strength steel material having an excellent delayed fracture resistance property, and a method of manufacturing the steel material. In particular, the invention relates to a steel material preferable for a high tensile strength steel material that has a tensile strength of 600 MPa or more, and is excellent in delayed fracture resistance property, and a method of manufacturing the steel material.

BACKGROUND ART

Recently, in a field using a steel material such as construction industrial machinery, a tank, penstock and a line pipe, a steel material to be used is oriented to be increased in strength, and use environment of a steel material becomes progressively harsher with increase in size of structures as background.

However, it is known that such increase in strength of a steel material and increase in harshness of use environment typically increase hydrogen embrittlement sensitivity of the steel material, and for example, in a field of high-strength bolt, a high strength steel material is restrictively used, for example, JIS B 1186 describes that F11T class bolt (with tensile strength of 1100 to 1300 N/mm$^2$) is preferably not used.

Therefore, documents described below, that is, patent document 1, patent document 2, patent document 3, patent document 4, and patent document 5 have proposed a method of manufacturing a steel sheet having an excellent hydrogen embrittlement resistance property using various techniques such as optimization of a composition, reinforcement of grain boundaries, refinement of crystal grains, use of hydrogen trap sites, structural morphology control, and fine dispersion of carbides.

[Patent document 1] JP-A-3-243745
[Patent document 2] JP-A-2003-73737
[Patent document 3] JP-A-2003-239041
[Patent document 4] JP-A-2003-253376
[Patent document 5] JP-A-2003-321743

DISCLOSURE OF THE INVENTION

However, even if each of the methods described in the patent documents 1 to 5 is used, when a strength level becomes higher, a delayed fracture resistance property, which is required when a steel material is used in harsh corrosion environment, is hardly obtained. Therefore, a high tensile strength steel material having a more excellent, delayed fracture resistance property particularly in a high level of tensile strength of 900 MPa or more, and a method of manufacturing the high tensile strength steel material have been required so far.

The invention was made in the light of such a circumference. That is, an object of the invention is to provide a high tensile strength steel material having an excellent delayed fracture resistance property compared with usual steel materials in a tensile strength of 600 MPa or more, and particularly 900 MPa or more, and provide a method of manufacturing the steel material (note; delayed fracture is known to be induced mainly due to an effect of hydrogen. From a view point of use environment of a steel material, harsher use environment of a steel material generally provides higher sensitivity of hydrogen to brittleness of the steel material. In the application, a property of reducing such sensitivity to delayed fracture of the high strength steel, and improving the delayed fracture resistance property is called "delayed fracture resistance property".)

To solve a problem as above, the invention took the following means. That is, delayed fracture occurs as a result of a phenomenon that hydrogen that can diffuse in steel at room temperature, so-called diffusible hydrogen is accumulated in a stress concentration portion, and the amount of the hydrogen reaches to a threshold value of the relevant material. As a measure for preventing this, one specific countermeasure idea for improving the delayed fracture resistance property, that is, means for decreasing the amount of diffusible hydrogen accumulated in the stress concentration portion is considered.

The inventors made earnest study to improve the delayed fracture resistance property of a steel material. As a result, they found the following. That is, added amount of Mo, Nb, V or Ti being an element for forming precipitates such as alloy carbides, and a heating rate at a central portion in a thickness direction of a steel material during tempering are specified, thereby precipitates can be finely dispersed, and appropriate amount of residual austenite can be secured. Increase in the amount of trapped diffusible hydrogen due to the precipitates and the residual austenite decreases the amount of diffusible hydrogen accumulated in the stress concentration portion. Thus, in the invention, a high tensile strength steel material can be obtained, which has an excellent delayed fracture resistance property compared with usual materials.

Furthermore, the inventor of the application found the following. That is, the added amount of elemental components to be contained, that is, the added amount of S, Ca and O is kept in an appropriate range, thereby a composite inclusion of CaS and MnS is made actively usable as a trap site of hydrogen. This further improves the delayed fracture resistance property of the steel material.

The invention was made after further investigation based on knowledge obtained as generally described above. That is, the invention provides a high tensile strength steel material having an excellent delayed fracture resistance property and a method of manufacturing the steel material as described below.

1. A high tensile strength steel material having an excellent delayed fracture resistance property contains, in mass percent, C of 0.02 to 0.25%, Si of 0.01 to 0.8%, Mn of 0.5 to 2.0%, Al of 0.005 to 0.1%, N of 0.0005 to 0.008%, P of 0.03% or less, and S of 0.03% or less, and at least one element selected from Mo of 0.01 to 1%, Nb of 0.001 to 0.1%, V of 0.001 to 0.5%, and Ti of 0.001 to 0.1%. The remainder includes Fe and inevitable impurities. In addition, precipitates contained in the steel include at least one of elements selected from Mo, Nb, V and Ti. The precipitates have an average grain size of 20 nm or less. The number of existing precipitates is at least 5 per 250000 nm$^2$. The high tensile strength steel material having an excellent delayed fracture resistance property is characterized by the above.

2. Furthermore, the high tensile strength steel material having an excellent delayed fracture resistance property according to 1 is characterized in that a steel composition contains at least one element among Cu of 2% or less, Ni of 4% or less, Cr of 2% or less, and W of 2% or less, in mass percent.

3. Furthermore, the high tensile strength steel material having an excellent delayed fracture resistance property according to 1 or 2 is characterized in that a steel composition contains at least one element among B of 0.003% or less, Ca of 0.01% or less, REM of 0.02% or less (note: REM is abbreviation of Rare Earth Metal), and Mg of 0.01% or less.

4. The high tensile strength steel material having an excellent delayed fracture resistance property according to any one of 1 to 3 further contains the following elements:

in mass percent, $0.0004 \leq S \leq 0.0025\%$, $0.0010 \leq Ca \leq 0.0030\%$, and $0.0008 \leq O \leq 0.0030\%$; wherein ACR obtained by the following expression satisfies $0.2 \leq ACR \leq 1.0$. Here, $$ACR=(Ca-(0.18+130*Ca)*O)/1.25/S$$

is given, wherein Ca, O or S shows the content (mass percent) of each component.

5. A high tensile strength steel material having an excellent delayed fracture resistance property characterized in that the steel material contains, in mass percent, C of 0.02 to 0.25%, Si of 0.01 to 0.8%, Mn of 0.5 to 2.0%, Al of 0.005 to 0.1%, N of 0.0005 to 0.008%, P of 0.03% or less, $0.0004\% \leq S \leq 0.0025\%$, $0.0010\% \leq Ca \leq 0.0030\%$, and $0.0008\% \leq O \leq 0.0030\%$, and at least one of elements selected from Mo of 0.01 to 1%, Nb of 0.001 to 0.1%, V of 0.001 to 0.5%, and Ti of 0.001 to 0.1%, wherein a value of ACR obtained by the following expression satisfies $0.2 \leq ACR \leq 1.0$, and the remainder includes Fe and inevitable impurities; in addition, precipitates containing at least one of elements selected from Mo, Nb, V and Ti have an average grain size of 20 nm or less, and the number of existing precipitates is at least 5 per 250000 $nm^2$. Here, $$ACR=(Ca-(0.18+130*Ca)*O)/1.25/S$$

is given, wherein Ca, O or S shows the content (mass percent) of each component, (note; In the application, ACR is an index showing a crystallization level of Ca based inclusions, which is abbreviation of Atomic Concentration Ratio.)

6. Furthermore, the high tensile strength steel material having an excellent delayed fracture resistance property according to 5 is characterized in that a steel composition contains at least one element among Cu of 2% or less, Ni of 4% or less, Cr of 2% or less, and W of 2% or less, in mass percent.

7. Furthermore, the high tensile strength steel material having an excellent delayed fracture resistance property according to 5 or 6 is characterized in that a steel composition contains at least one element among B of 0.003% or less, REM of 0.02% or less, and Mg of 0.01% or less, in mass percent.

8. The high tensile strength steel material having an excellent delayed fracture resistance property according to any one of 1 to 6 is characterized in that the steel material includes residual austenite in a volume fraction of 0.5 to 5%.

9. A method of manufacturing the high tensile strength steel material having an excellent delayed fracture resistance property according to any one of 1 to 7, the method includes, a step of quenching the steel material from a temperature of Ar3 transformation temperature to a temperature of 500° C. or less, and a step of tempering the steel material while a central portion of the steel material is heated from a tempering start temperature to a predetermined tempering temperature at an average heating rate of 1° C./s or more, after the quenching.

BEST MODE FOR CARRYING OUT THE INVENTION

[Composition]

First, regarding a composition of the invention, the reason for limiting each component is described. Each symbol % showing a chemical composition is mass percent.

C: 0.02 to 0.25%

C is contained to secure certain tensile strength. However, when C is less than 0.02%, such a containing effect is insufficient. On the other hand, when Cis more than 0.25%, a base metal and a weld heat affected zone are degraded in toughness, and weldability is significantly degraded. Therefore, the content of C is limited to be 0.02 to 0.25%.

Si: 0.01 to 0.8%

Si is contained as a deoxidizing agent in a steel making stage and as an element for improving strength. However, when Si is less than 0.01%, such a containing effect is insufficient. On the other hand, when Si is more than 0.8%, grain boundaries are embrittled, accelerating occurrence of delayed fracture. Therefore, the content of Si is limited to be 0.01 to 0.8%.

Mn: 0.5 to 2.0%

Mn is contained to secure certain tensile strength. However, when Mn is less than 0.5%, such a containing effect is insufficient. On the other hand, when Mn is more than 2.0%, toughness of a weld heat affected zone is degraded, and weldability is significantly degraded. Therefore, the content of Mn is limited to be 0.5 to 2.0%.

Al: 0.005 to 0.1%

Al is added as a deoxidizing agent, in addition, has an effect on refinement of crystal grain size. However, when Al is less than 0.005%, such a containing effect is insufficient. On the other hand, when Al is contained more than 0.1%, surface flaws of a steel sheet are easily made. Therefore, the content of Al is limited to be 0.005 to 0.1%.

N: 0.0005 to 0.008%

N is added because it refines a structure by forming nitrides with Ti or the like and thus improves toughness of the base metal and the weld heat affected zone. When N is added less than 0.0005%, the effect of refining a structure is not sufficiently provided, and on the other hand, when N is added more than 0.008%, the amount of dissolved N is increased, and therefore toughness of the base metal and the weld heat affected zone is degraded. Therefore, the content of N is limited to be 0.0005 to 0.008%.

P: 0.03% or Less, S: 0.03% or Less

Each of P and S is an impurity element, and when it is more than 0.03%, sound base metal and sound welding joint cannot be obtained. Therefore, the content of each of P and S is limited to be 0.03% or less. Here, regarding S, since inclusions of S can be used as trap sites of hydrogen, it is preferably specified to be $0.0004\% \leq S \leq 0.0025\%$. When S is less than 0.0004%, appropriate amount of dispersed inclusions cannot be secured, and the trap sites of hydrogen are decreased, consequently inclusions do not substantially exhibit an effect on delayed fracture resistance. When S is more than 0.0025%, the amount of inclusions is excessively increased and therefore ductile fracture strength is reduced, consequently toughness may be degraded.

O: 0.0008%≤O≤0.0030%

O is preferably specified to be 0.0008%≤O≤0.0030% since inclusions can be used for trap sites of hydrogen. When O is less than 0.0008%, appropriate amount of dispersed inclusions cannot be secured, and the trap sites of hydrogen are decreased, consequently inclusions do not exhibit the effect on delayed fracture resistance as the inclusions. When O is more than 0.0030%, the amount of inclusions is excessively increased and therefore ductile fracture strength is reduced, consequently toughness may be degraded.

At least one selected from Mo, Nb, V and Ti

When the steel material contains at least one of Mo, Nb, V and Ti, the steel material has an effect of trapping diffusible hydrogen and thus improving the delayed fracture resistance property. Therefore, the steel material contains at least one of Mo of 0.01 to 1%, Nb of 0.001 to 0.1%, V of 0.001 to 0.5% and Ti of 0.001 to 0.1%.

Hereinafter, description is made on ranges in which Mo, Nb, V and Ti are specified respectively.

Mo: 0.01 to 1%

Mo has a function of improving hardenability and strength, in addition, traps diffusible hydrogen by forming carbides, thereby improves the delayed fracture resistance property. When Mo is added less than 0.01%, such a containing effect is insufficient, and on the other hand, when it is added more than 1%, economic efficiency is reduced. Therefore, when Mo is added, the content is limited to be 0.01 to 1%. In particular, Mo has a function of increasing tempering softening resistance, and is preferably added 0.2% or more to secure tensile strength of 900 MPa or more.

Nb: 0.001 to 0.1%

Nb improves strength as a microalloying element, in addition, traps diffusible hydrogen by forming carbides, nitrides, or carbon-nitrides, so that improves the delayed fracture resistance property. When Nb is added less than 0.001%, such an effect is insufficient, and on the other hand, when it is added more than 0.1%, toughness of a weld heat affected zone is degraded. Therefore, when Nb is added, the content is limited to be 0.001 to 0.1%.

V: 0.001 to 0.5%

V improves strength as a microalloying element, in addition, traps diffusible hydrogen by forming carbides, nitrides, or carbon-nitrides, thereby improves the delayed fracture resistance property. When V is added less than 0.001%, such an effect is insufficient, and on the other hand, when it is added more than 0.5%, toughness of a weld heat affected zone is degraded. Therefore, when V is added, the content is limited to be 0.001 to 0.5%.

Ti: 0.001 to 0.1%

Ti forms TiN during rolling heating or during welding, thereby inhibits growth of austenite grains, and thereby improves toughness of a base metal and weld heat affected zone, in addition, traps diffusible hydrogen by forming carbides, nitrides, or carbon-nitrides, thereby improves the delayed fracture resistance property.

Furthermore, Ti has an effect of trapping diffusible hydrogen by forming a composite precipitate with Mo or Nb, thereby improving the delayed fracture resistance property. However, when Ti is added less than 0.001%, such an effect is insufficient, and on the other hand, when it is added more than 0.1%, toughness of a weld heat affected zone is degraded. Therefore, when Ti is added, the content is limited to be 0.001 to 0.1%.

Furthermore, in the invention, the steel material may contain the following components depending on a desired property. That is, components that the steel material may further contain depending on a desired property are as follows.

Cu: 2% or Less

Cu has a function of improving strength by solution hardening and precipitation hardening. However, when the content of Cu exceeds 2%, cracking in hot working tends to occur during heating a steel billet or welding. Therefore, when Cu is added, the content is limited to be 2% or less.

Ni: 4% or Less

Ni has a function of improving toughness and hardenability. However, when the content of Ni exceeds 4%, economic efficiency is reduced. Therefore, when Ni is added, the content is limited to be 4% or less.

Cr: 2% or Less

Cr has a function of improving strength and toughness, and is excellent in high temperature strength property. Therefore, when a steel material is intended to be increased in strength, Cr is actively added, and particularly, Cr of 0.3% or more is preferably added to obtain a property of tensile strength of 900 MPa or more. However, when the content of Cr exceeds 2%, weldability is degraded. Therefore, when Cr is added, the content is limited to be % or less.

W: 4% or Less

W has a function of improving strength. However, when the content of W exceeds 2%, weldability is degraded. Therefore, when W is added, the content is limited to be 2% or less.

B: 0.003% or Less

B has a function of improving hardenability. However, when the content of B exceeds 0.003%, toughness is degraded. Therefore, when B is added, the content is limited to be 0.003% or less.

Ca: 0.01% or Less

Ca is an element indispensable for morphology control of sulfide based inclusions. However, when Ca is added more than 0.01%, reduction in cleanliness is caused. Therefore, when Ca is added, the content is limited to be 0.01% or less.

Preferably, regarding Ca, since inclusions of Ca can be used as trap sites of hydrogen, it is specified to be 0.0010%≤Ca≤0.0030%. When Ca is less than 0.0010%, appropriate amount of dispersed inclusions-cannot be secured, and the trap sites of hydrogen are decreased, consequently inclusions do not substantially exhibit an effect on delayed fracture resistance.

When Ca is more than 0.0030%, the amount of inclusions is excessively increased and therefore ductile fracture strength is reduced, consequently toughness may be degraded.

However, when Ca is specified to be 0.0010≤Ca≤0.0030%, the amount of O in steel is specified to be 0.0008≤O≤0.0030%, and ACR obtained by the following expression is specified to be 0.2≤ACR≤1.0.

Here, in the expression, ACR=(Ca−(0.18+130*Ca)*O)/1.25/S, Ca, O or S shows the content (mass percent) in steel respectively.

ACR is specified to be 0.2≤ACR≤1.0 so that the composite inclusion of CaS and MnS is actively used as the trap site of hydrogen to improve the delayed fracture resistance property. Ca, O and S are contained such that ACR satisfies such range, thereby CaS and MnS are prevented from being crystallized as nucleuses respectively, and can be dispersed as fine composite inclusions.

As a result, hydrogen is trapped in interfaces between the composite inclusions and a matrix, so that accumulation of hydrogen in interfacial surface of only part of inclusions can be suppressed. Furthermore, alloy carbides are precipitated on surfaces of the composite inclusions in a rapid-heating tempering process, thereby a larger amount of hydrogen are trapped. When ACR is less than 0.2, a nucleus of inclusions is MnS, and the inclusions are extended by rolling and thereby tend to be initial points of delayed fracture, consequently the delayed fracture resistance property is sometimes degraded.

When ACR is 1.0 or more, a nucleus of inclusions is CaS, and the inclusions tend to be coarse, and in some cases, the coarse inclusions become initial points of delayed fracture, consequently the delayed fracture resistance property is degraded.

More preferably, ACR is in a range of $0.4 \leq ACR \leq 0.8$.

In usual cases, since MnS is extended by rolling, and hydrogen is accumulated in such extended portions, thereby cracks tend to occur, Ca is added so as to satisfy $ACR \geq 1.0$, so that S is fixed to perform morphology control of MnS.

REM: 0.02% or Less

REM forms sulfides as REM (O, S) in steel and thus decreases the amount of dissolved S in crystal grain boundaries, so that it improves an SR crack resistance property. However, when REM is added more than 0.02%, REM sulfides are significantly accumulated in a precipitation zone, causing degradation in material. Therefore, when REM is added, added amount is limited to be 0.02% or less.

Mg: 0.01% or Less

Mg is sometimes used as a molten-iron desulfurizing agent. However, when Mg is added more than 0.01%, reduction in cleanliness is caused. Therefore, when Mg is added, added amount is limited to be 0.01% or less.

Next, description is made on the reason for limiting a precipitation pattern of precipitates in the invention. First, from a viewpoint of a microstructure of the precipitates, the reason for limiting the precipitation pattern is described below.

[Microstructure]

In the invention, precipitates containing at least one of elements selected from Mo, Nb, V and Ti have an average grain size of 20 nm or less, and preferably 15 nm or less. The number of precipitates contained in the steel is at least 5 per 250000 $nm^2$, and preferably at least 10 per 250000 $nm^2$. (note; Here, the precipitates typically include a carbide, nitride, carbon-nitride, and compound of them.)

The precipitates are observed by a transmission electron microscope by using a sample of a thin film or extraction replica or the like. The grain size is evaluated using a circle-equivalent diameter from image analysis, and the average grain size is, for example, assumed as a simple average value for at least five, optional view fields using precipitates observed in a view field 500 nm square as an object.

While the precipitates containing at least one of elements selected from Mo, Nb, V and Ti have an effect of trapping diffusible hydrogen irrespectively of size, when the average grain size is more than 20 nm, lattice matching is reduced, leading to reduction in force of trapping diffusible hydrogen. As a result, in the steel material, the effect of improving the delayed fracture resistance property is reduced. Thus, the average grain size is specified to be 20 nm or less, and preferably 15 nm or less.

When density of the precipitates containing at least one of elements selected from Mo, Nb, V and Ti is less than 5 per 250000 $nm^2$, the amount of diffusible hydrogen trapped by the precipitates is decreased, leading to reduction in effect of improving the delayed fracture resistance property. Thus, the precipitates are specified to be contained in a ratio of at least 5 per 250000 $nm^2$ or more, and preferably at least 10 per 250000 $nm^2$.

Next, in a viewpoint of the residual austenite, the reason for limiting the precipitation pattern is described below.

[Residual Austenite]

Residual austenite acts as a hydrogen trap site because of high solid solubility of hydrogen, and thereby improves the delayed fracture resistance property. However, such an effect is not sufficient in a volume fraction of residual austenite of less than 0.5%, but strength is reduced in a volume fraction of more than 5%. Therefore, the residual austenite is preferably specified to be in a volume fraction of 0.5 to 5%, and more preferably in a volume fraction of 2 to 4%.

The volume fraction of the amount of residual austenite is measured by, for example, quantizing peaks of the lattice constant of austenite using X-ray diffraction.

Next, a manufacturing method of the invention is described.

In the invention, a steel billet can be manufactured such that the billet can be quenched from the $Ar_3$ transformation temperature or more, and a method of manufacturing a cast billet from molten steel, or a method of manufacturing a steel billet by rolling a cast billet is not particularly specified. Steel ingoted by a converter method, an electric furnace method and the like, or a slab manufactured by continuous casting, an ingot mold method and the like can be used.

When a steel billet is manufactured by rolling a cast billet, the cast billet as it is may be started to be subjected to hot rolling without being cooled to the $Ar_3$ transformation temperature or less, or may be started to be subjected to hot rolling after a cast billet that was once cooled is reheated to the $Ar_3$ transformation temperature or more.

If rolling is finished at the $Ar_3$ transformation temperature or more, other rolling conditions may not be particularly specified. If rolling is performed at a temperature of the $Ar_3$ transformation temperature or more, the rolling may be performed in a recrystallization range or a non-recrystallization range.

In the invention, if quenching is started from a state of an austenite single phase structure at the $Ar_3$ transformation temperature or more, the quenching may be performed directly after hot rolling, or may be performed after reheating a hot-rolled material.

As a heating method during tempering, if a required heating rate is achieved, any of methods of induction heating, resistance heating, infrared radiation heating, atmospheric heating and the like can be used.

Next, description is made on a manufacturing condition preferable for manufacturing steel in the invention. The invention can be applied to steel materials in various forms such as a steel sheet, shape steel, and rod steel. In the manufacturing condition, temperature is specified with temperature at a central portion of the steel material, which is a center in thickness in the steel sheet, a center in thickness in a region, to which properties according to the invention are added, in the shape steel, and a center in a radial direction in the rod steel. However, since the neighborhood of the central portion is subjected to substantially the same temperature history, the central portion is not limited to the center itself.

A manufacturing condition preferable for manufacturing the steel of the invention is described below from a viewpoint of quenching and tempering.

A quenching condition in the invention is as follows.

To secure strength and toughness of a base metal, quenching is performed from a temperature of the $Ar_3$ transformation temperature or more to a temperature of 500° C. or less. In the quenching, cooling is performed at a rate of 0.5° C./sec or more, and preferably 1° C./sec or more.

These are specified to complete transformation from austenite to martensite or bainite to reinforce a base metal.

While an expression for obtaining the $Ar_3$ transformation temperature (° C.) is not particularly specified in the invention, for example, $Ar_3$=910-310C-80Mn-20Cu-15Cr-55Ni- 80Mo is assumed. In the expression, each elemental symbol shows the content (mass percent) in steel.

A tempering condition in the invention is as follows.

During tempering, an average heating rate is set to be 1° C./sec or more and preferably set to be 2° C./sec or more from a tempering start temperature to a predetermined tempering temperature. In the case that steel is temporarily cooled to room temperature due to reheating quenching, the average heating rate is also set to be 1° C./sec or more, and preferably set to be 2° C./sec or more during tempering.

Behavior of formation or growth of precipitates formed during tempering, including alloy carbides, alloy nitrides, alloy carbon-nitrides and the like is affected by a heating rate during tempering, and when the average heating rate is also set to be 1° C./sec or more, and preferably set to be 2° C./sec or more, fine dispersion of precipitates is achieved.

When the rate is less than 1° C./sec, since C is diffused into grain boundaries or lath interfaces before carbides or carbon-nitrides precipitate, only coarse carbides or carbon-nitrides can be obtained, consequently an effect of finely dispersing carbides or carbon-nitrides to be as trap sites of hydrogen is not obtained.

Furthermore, in tempering, when a temperature range where a heating rate at 600° C. or more is at least 10° C./sec is included, an alloy element is substituted for Fe in dispersedly precipitated cementite, which preferably accelerates precipitation of fine alloy carbides.

When a steel material is increased in strength to have a tensile strength of 900 MPa or more, it is preferable for obtaining a well-balanced property of high strength and high toughness that tempering temperature is set to be in a range of 450 to 550° C.

Furthermore, for a heating process during tempering, it is enough that a predetermined average heating rate is obtained, and either of a linear temperature history, and a temperature history in which temperature is retained during heating may be used, that is, a temperature history is not particularly specified.

Holding time at tempering temperature is desirably 60 sec or less to prevent degradation in productivity, or degradation in delayed fracture resistance property due to coarsening of precipitates:

Regarding a cooling rate after tempering, it is desirable that an average cooling rate is set to be 0.05° C./sec or more from the tempering temperature to 200° C. to prevent coarsening of precipitates during cooling.

According to the above conditions, since the amount of trapped diffusible hydrogen due to the precipitates is increased, the amount of diffusible hydrogen accumulated in a stress concentration portion is decreased, consequently the delayed fracture resistance property is improved compared with that of usual steel materials.

Example

Effectiveness of the invention is described using an example. Steel A to steel P and Steel Q to steel U of chemical composition shown in Tables 1 and 4 were ingoted and casted into slabs, then the slabs were heated in a heating furnace and then rolled into steel sheets. After rolling, successively, the steel sheets were directly quenched, and then subjected to tempering using a solenoid-type induction heating apparatus.

An average heating rate at a central portion in thickness was controlled by using threading speed of a steel sheet. When a steel sheet was held at the tempering temperature, the steel sheet was heated while being reciprocated, so that it was held within a variation range of ±5° C.

As cooling after heating, air cooling was used. Temperature such as tempering temperature or quenching temperature at a central portion in thickness was obtained by heat transfer calculation from a result of sequential temperature measurement of a surface using a radiation thermometer.

Table 2 shows manufacturing conditions of the steel sheets, average grain size of precipitates, density of the precipitates, and volume fractions of residual austenite, and Table 3 shows yield strength, tensile strength, fracture transition temperature (vTrs), and amount of critical diffusible hydrogen.

For the size and density of the precipitates, precipitates extracted by using an extraction replica were photographed using a transmission electron microscope, then average was obtained for five, optional view fields using precipitates observed in a view field 500 nm square as an object. Grain size was evaluated using a circle-equivalent diameter from image analysis.

The volume fraction of residual austenite was measured by quantizing peaks of the lattice constant of austenite using X-ray diffraction.

The yield strength and the tensile strength were measured using full-thickness tensile test pieces, and the toughness was evaluated by vTrs obtained by a Charpy impact test using test pieces sampled from central portions in thickness.

Furthermore, the amount of critical diffusible hydrogen was defined as maximum amount of diffusible hydrogen at which delayed fracture did not occur within 100 hr under constant load of 90% of tensile strength, and a round-bar tensile test piece with circular notch was used as a test piece, and the amount of diffusible hydrogen was measured by gas chromatography method.

An objective value of the amount of critical diffusible hydrogen was set to be at least 0.2 ppm by mass for a steel type having a tensile strength of 1200 MP or more, and set to be at least 0.3 ppm by mass for a steel type having a tensile strength of less than 1200 MP.

TABLE 1

(mass %)

| Steel type | C | Si | Mn | P | S | Cu | Ni | Cr | Mo | Nb | V | Ti |
|---|---|---|---|---|---|---|---|---|---|---|---|---|
| A | 0.08 | 0.20 | 1.35 | 0.011 | 0.002 | 0.00 | 0.00 | 0.03 | 0.05 | 0.020 | 0.034 | 0.000 |
| B | 0.09 | 0.26 | 1.45 | 0.018 | 0.002 | 0.00 | 0.00 | 0.03 | 0.19 | 0.021 | 0.035 | 0.000 |
| C | 0.14 | 0.32 | 1.09 | 0.014 | 0.006 | 0.00 | 0.00 | 0.06 | 0.09 | 0.019 | 0.008 | 0.010 |
| D | 0.16 | 0.26 | 1.01 | 0.014 | 0.002 | 0.02 | 0.01 | 0.64 | 0.15 | 0.000 | 0.041 | 0.012 |
| E | 0.12 | 0.40 | 1.52 | 0.012 | 0.002 | 0.02 | 0.01 | 0.26 | 0.40 | 0.020 | 0.000 | 0.010 |
| F | 0.12 | 0.41 | 1.52 | 0.014 | 0.002 | 0.00 | 0.00 | 0.51 | 0.41 | 0.020 | 0.042 | 0.013 |
| G | 0.15 | 0.41 | 1.52 | 0.014 | 0.002 | 0.00 | 0.00 | 0.50 | 0.43 | 0.020 | 0.000 | 0.011 |
| H | 0.12 | 0.41 | 1.52 | 0.014 | 0.002 | 0.30 | 0.30 | 0.51 | 0.21 | 0.020 | 0.042 | 0.013 |
| I | 0.17 | 0.41 | 1.21 | 0.014 | 0.002 | 0.00 | 0.00 | 0.51 | 0.69 | 0.020 | 0.000 | 0.013 |
| J | 0.17 | 0.42 | 1.19 | 0.005 | 0.002 | 0.26 | 0.28 | 0.34 | 0.65 | 0.019 | 0.044 | 0.012 |

TABLE 1-continued

| | | | | | | | | | | | | (mass %) |
|---|---|---|---|---|---|---|---|---|---|---|---|---|
| K | 0.18 | 0.27 | 1.35 | 0.002 | 0.001 | 0.26 | 0.24 | 0.53 | 0.52 | 0.022 | 0.052 | 0.013 |
| L | 0.23 | 0.35 | 1.40 | 0.009 | 0.003 | 0.19 | 2.26 | 0.79 | 0.70 | 0.020 | 0.041 | 0.012 |
| M | 0.18 | 0.32 | 1.62 | 0.014 | 0.006 | 0.32 | 0.35 | 0.06 | 0.00* | 0.000* | 0.000* | 0.000* |
| N | 0.20 | 0.40 | 1.77 | 0.012 | 0.002 | 0.50 | 0.50 | 0.50 | 0.00* | 0.000* | 0.000* | 0.000* |
| O | 0.24 | 0.41 | 1.89 | 0.014 | 0.002 | 0.61 | 0.63 | 0.51 | 0.00* | 0.000* | 0.000* | 0.000* |
| P | 0.24 | 0.41 | 1.89 | 0.014 | 0.002 | 1.05 | 1.02 | 0.51 | 0.00* | 0.000* | 0.000* | 0.000* |

| Steel type | B | Ca | REM | Mg | Al | T.N | $Ar_3$ (° C.) | Remarks |
|---|---|---|---|---|---|---|---|---|
| A | 0.0000 | 0.0000 | 0.0000 | 0.0000 | 0.031 | 0.0032 | 773 | Example of the invention |
| B | 0.0000 | 0.0000 | 0.0000 | 0.0000 | 0.028 | 0.0029 | 750 | Example of the invention |
| C | 0.0010 | 0.0000 | 0.0000 | 0.0000 | 0.022 | 0.0037 | 771 | Example of the invention |
| D | 0.0012 | 0.0000 | 0.0000 | 0.0000 | 0.030 | 0.0030 | 757 | Example of the invention |
| E | 0.0013 | 0.0000 | 0.0000 | 0.0000 | 0.027 | 0.0031 | 714 | Example of the invention |
| F | 0.0010 | 0.0000 | 0.0000 | 0.0000 | 0.032 | 0.0037 | 711 | Example of the invention |
| G | 0.0015 | 0.0000 | 0.0000 | 0.0000 | 0.024 | 0.0024 | 700 | Example of the invention |
| H | 0.0010 | 0.0000 | 0.0000 | 0.0000 | 0.032 | 0.0030 | 704 | Example of the invention |
| I | 0.0010 | 0.0000 | 0.0025 | 0.0000 | 0.032 | 0.0030 | 698 | Example of the invention |
| J | 0.0012 | 0.0000 | 0.0000 | 0.0015 | 0.028 | 0.0046 | 684 | Example of the invention |
| K | 0.0015 | 0.0032 | 0.0000 | 0.0000 | 0.052 | 0.0035 | 678 | Example of the invention |
| L | 0.0013 | 0.0025 | 0.0030 | 0.0000 | 0.027 | 0.0037 | 531 | Example of the invention |
| M | 0.0010 | 0.0000 | 0.0000 | 0.0000 | 0.052 | 0.0037 | 698 | Comparative example |
| N | 0.0013 | 0.0000 | 0.0000 | 0.0000 | 0.068 | 0.0031 | 661 | Comparative example |
| O | 0.0010 | 0.0000 | 0.0000 | 0.0000 | 0.057 | 0.0037 | 630 | Comparative example |
| P | 0.0010 | 0.0000 | 0.0000 | 0.0000 | 0.056 | 0.0030 | 600 | Comparative example |

Note 1:

A mark * shows the value is out of the range of the invention.

Note 2:

$Ar_3$ = 910-310C—80Mn—20Cu—15Cr—55Ni—80Mo

TABLE 2-1

| No. | Steel type | Thickness (mm) | Heating temperature (° C.) | Direct quenching start temperature (° C.) | Direct quenching stop temperature (° C.) | tempering start temperature (° C.) | tempering temperature (° C.) | Average heating rate at a central portion in thickness from tempering start temperature to tempering temperature (° C./s) |
|---|---|---|---|---|---|---|---|---|
| 1 | A | 10 | 1150 | 830 | 170 | 150 | 560 | 23.1 |
| 2 | B | 25 | 1130 | 810 | 430 | 410 | 620 | 1.5 |
| 3 | C | 25 | 1130 | 850 | 180 | 160 | 580 | 1.4 |
| 4 | D | 25 | 1100 | 830 | 230 | 210 | 520 | 2.0 |
| 5 | E | 25 | 1050 | 820 | 170 | 150 | 600 | 2.0 |
| 6 | F | 12 | 1200 | 830 | 210 | 190 | 640 | 25.1 |
| 7 | G | 25 | 1100 | 850 | 130 | 110 | 680 | 12.3 |
| 8 | H | 50 | 1130 | 820 | 170 | 150 | 600 | 2.5 |
| 9 | I | 12 | 1150 | 830 | 180 | 160 | 640 | 25.4 |
| 10 | J | 25 | 1150 | 830 | 190 | 170 | 600 | 11.7 |
| 11 | K | 50 | 1130 | 850 | 100 | 80 | 580 | 4.0 |
| 12 | L | 25 | 1130 | 850 | 100 | 80 | 600 | 8.9 |
| 13 | G | 6 | 1100 | 720 | 150 | 130 | 400 | 45.5 |
| 14 | I | 12 | 1100 | 740 | 230 | 210 | 450 | 27.3 |
| 15 | J | 25 | 1100 | 760 | 140 | 120 | 490 | 12.3 |
| 16 | K | 60 | 1110 | 700 | 100 | 80 | 500 | 1.6 |
| 17 | M | 25 | 1100 | 820 | 220 | 200 | 430 | 8.5 |
| 18 | N | 25 | 1150 | 830 | 160 | 140 | 450 | 7.9 |
| 19 | O | 25 | 1130 | 850 | 150 | 130 | 440 | 6.0 |

TABLE 2-1-continued

| | | | | | | | | |
|---|---|---|---|---|---|---|---|---|
| 20 | P | 25 | 1130 | 840 | 140 | 120 | 450 | 6.5 |
| 21 | A | 10 | 1150 | 710* | 170 | 150 | 560 | 23.1 |
| 22 | B | 25 | 1130 | 810 | 530* | 510 | 620 | 1.5 |
| 23 | C | 25 | 1130 | 850 | 180 | 160 | 580 | 0.7* |
| 24 | D | 25 | 1100 | 830 | 230 | 210 | 520 | 0.7* |
| 25 | E | 25 | 1050 | 820 | 170 | 150 | 600 | 0.7* |
| 26 | F | 12 | 1200 | 830 | 210 | 190 | 640 | 0.9* |
| 27 | G | 25 | 1100 | 850 | 130 | 110 | 680 | 0.7* |
| 28 | H | 50 | 1130 | 820 | 170 | 150 | 600 | 0.3* |
| 29 | I | 12 | 1150 | 830 | 180 | 160 | 640 | 0.9* |
| 30 | J | 25 | 1150 | 830 | 190 | 170 | 600 | 0.7* |
| 31 | K | 50 | 1130 | 850 | 100 | 80 | 580 | 0.2* |
| 32 | L | 25 | 1130 | 850 | 100 | 80 | 600 | 0.6* |
| 33 | Q | 25 | 1130 | 830 | 200 | 170 | 650 | 20.0 |
| 34 | R | 30 | 1150 | 830 | 200 | 170 | 490 | 5.0 |
| 35 | S | 35 | 1100 | 830 | 200 | | 490 | 5.0 |
| 36 | S | 35 | 1100 | 830 | 200 | 170 | 490 | 15.0 |
| 37 | T | 50 | 1050 | 850 | 150 | | 520 | 5.0 |
| 38 | T | 50 | 1050 | 850 | 150 | 120 | 520 | 15.0 |
| 39 | U | 60 | 1200 | 850 | 150 | 120 | 500 | 3.0 |

| No. | Holding time at tempering temperature (s) | Average cooling rate from tempering temperature to 200° C. (° C./s) | Average grain size of precipitates (nm) | Density of precipitates (per 250000 $nm^2$) | Residual austenite (volume fraction %) | Remarks |
|---|---|---|---|---|---|---|
| 1 | 0 | 0.8 | 3 | 22 | 0.5 | Example of the invention |
| 2 | 0 | 0.3 | 4 | 28 | 0.5 | Example of the invention |
| 3 | 0 | 0.3 | 3 | 15 | 1.0 | Example of the invention |
| 4 | 0 | 0.3 | 3 | 11 | 1.0 | Example of the invention |
| 5 | 0 | 0.3 | 3 | 18 | 1.0 | Example of the invention |
| 6 | 0 | 0.6 | 9 | 24 | 2.0 | Example of the invention |
| 7 | 0 | 0.3 | 18 | 19 | 2.5 | Example of the invention |
| 8 | 60 | 0.2 | 3 | 42 | 3.0 | Example of the invention |
| 9 | 0 | 0.6 | 12 | 26 | 3.5 | Example of the invention |
| 10 | 0 | 0.3 | 3 | 16 | 4.0 | Example of the invention |
| 11 | 60 | 0.2 | 4 | 13 | 4.0 | Example of the invention |
| 12 | 0 | 0.3 | 3 | 23 | 0.0 | Example of the invention |
| 13 | 0 | 1.3 | 5 | 11 | 3.0 | Example of the invention |
| 14 | 0 | 0.6 | 6 | 15 | 4.0 | Example of the invention |
| 15 | 0 | 0.3 | 4 | 16 | 4.5 | Example of the invention |
| 16 | 0 | 0.1 | 3 | 23 | 4.5 | Example of the invention |
| 17 | 0 | 0.3 | —* | 0* | 0.0* | Comparative example |
| 18 | 0 | 0.3 | —* | 0* | 0.0* | Comparative example |
| 19 | 0 | 0.3 | —* | 0* | 0.0* | Comparative example |
| 20 | 0 | 0.3 | —* | 0* | 6.5* | Comparative example |
| 21 | 0 | 0.8 | 9 | 3* | 0.0* | Comparative example |
| 22 | 0 | 0.3 | 11 | 4* | 0.0* | Comparative example |
| 23 | 0 | 0.3 | 6 | 3* | 0.0* | Comparative example |
| 24 | 0 | 0.3 | 7 | 2* | 0.0* | Comparative example |
| 25 | 0 | 0.3 | 9 | 2* | 0.0* | Comparative example |

TABLE 2-1-continued

| | | | | | | |
|---|---|---|---|---|---|---|
| 26 | 0 | 0.6 | 16 | 4* | 0.0* | Comparative example |
| 27 | 0 | 0.3 | 24* | 9 | 0.0* | Comparative example |
| 28 | 60 | 0.2 | 9 | 2* | 0.0* | Comparative example |
| 29 | 0 | 0.6 | 22* | 5 | 0.0* | Comparative example |
| 30 | 0 | 0.3 | 7 | 2* | 0.0* | Comparative example |
| 31 | 60 | 0.2 | 10 | 1* | 0.0* | Comparative example |
| 32 | 0 | 0.3 | 8 | 2* | 5.5* | Comparative example |
| 33 | 60 | 0.3 | 3 | 48 | 0.5 | Example of the invention |
| 34 | 0 | 0.3 | 3 | 52 | 0.5 | Example of the invention |
| 35 | 0 | 0.3 | 3 | 55 | 1.0 | Example of the invention |
| 36 | 0 | 0.3 | 2 | 72 | 1.0 | Example of the invention |
| 37 | 0 | 0.3 | 3 | 52 | 1.5 | Example of the invention |
| 38 | 0 | 0.3 | 2 | 75 | 1.5 | Example of the invention |
| 39 | 60 | 0.3 | 3 | 53 | 0.5 | Example of the invention |

Note 1:

A mark * shows the value is out of the range of the invention. However, a mark * in a column of residual austenite shows the value is out of the invention according to claim 7.

Note 2:

Average grain size (—) shows Mo, Nb, V or Ti based precipitates do not exist.

TABLE 2-2

| No. | Steel type | Thickness (mm) | Heating temperature (° C.) | Direct quenching start temperature (° C.) | Direct quenching stop temperature (° C.) | tempering start temperature (° C.) | tempering temperature (° C.) | Average heating rate at a central portion in thickness from tempering start temperature to tempering temperature (° C./s) | Holding time at tempering temperature (s) | Average cooling rate from tempering temperature to 200° C. (° C./s) | Average grain size of precipitates (nm) | Density of precipitates (per 250000 $nm^2$) | Residual austenite (volume fraction %) | Remarks |
|---|---|---|---|---|---|---|---|---|---|---|---|---|---|---|
| 21 | A | 10 | 1150 | 710* | 170 | 150 | 560 | 23.1 | 0 | 0.8 | 9 | 3* | 0.0* | Comparative example |
| 22 | B | 25 | 1130 | 810 | 530* | 510 | 620 | 1.5 | 0 | 0.3 | 11 | 4* | 0.0* | Comparative example |
| 23 | C | 25 | 1130 | 850 | 180 | 160 | 580 | 0.7* | 0 | 0.3 | 6 | 3* | 0.0* | Comparative example |
| 24 | D | 25 | 1100 | 830 | 230 | 210 | 520 | 0.7* | 0 | 0.3 | 7 | 2* | 0.0* | Comparative example |
| 25 | E | 25 | 1050 | 820 | 170 | 150 | 600 | 0.7* | 0 | 0.3 | 9 | 2* | 0.0* | Comparative example |
| 26 | F | 12 | 1200 | 830 | 210 | 190 | 640 | 0.9* | 0 | 0.6 | 16 | 4* | 0.0* | Comparative example |
| 27 | G | 25 | 1100 | 850 | 130 | 110 | 680 | 0.7* | 0 | 0.3 | 24* | 9 | 0.0* | Comparative example |
| 28 | H | 50 | 1130 | 820 | 170 | 150 | 600 | 0.3* | 60 | 0.2 | 9 | 2* | 0.0* | Comparative example |
| 29 | I | 12 | 1150 | 830 | 180 | 160 | 640 | 0.9* | 0 | 0.6 | 22* | 5 | 0.0* | Comparative example |
| 30 | J | 25 | 1150 | 830 | 190 | 170 | 600 | 0.7* | 0 | 0.3 | 7 | 2* | 0.0* | Comparative example |
| 31 | K | 50 | 1130 | 850 | 100 | 80 | 580 | 0.2* | 60 | 0.2 | 10 | 1* | 0.0* | Comparative example |
| 32 | L | 25 | 1130 | 850 | 100 | 80 | 600 | 0.6* | 0 | 0.3 | 8 | 2* | 5.5* | Comparative example |
| 33 | Q | 25 | 1130 | 830 | 200 | 170 | 650 | 20.0 | 60 | 0.3 | 3 | 48 | 0.5 | Example of the invention |
| 34 | R | 30 | 1150 | 830 | 200 | 170 | 490 | 5.0 | 0 | 0.3 | 3 | 52 | 0.5 | Example of the invention |
| 35 | S | 35 | 1100 | 830 | 200 | Room Temperature | 490 | 5.0 | 0 | 0.3 | 3 | 55 | 1.0 | Example of the invention |
| 36 | S | 35 | 1100 | 830 | 200 | 170 | 490 | 15.0 | 0 | 0.3 | 2 | 72 | 1.0 | Example of the invention |
| 37 | T | 50 | 1050 | 850 | 150 | Room Temperature | 520 | 5.0 | 0 | 0.3 | 3 | 52 | 1.5 | Example of the invention |

TABLE 2-2-continued

| No. | Steel type | Thickness (mm) | Heating temperature (° C.) | Direct quenching start temperature (° C.) | Direct quenching stop temperature (° C.) | tempering start temperature (° C.) | tempering temperature (° C.) | Average heating rate at a central portion in thickness from tempering start temperature to tempering temperature (° C./s) | Holding time at tempering temperature (s) | Average cooling rate from tempering temperature to 200° C. (° C./s) | Average grain size of precipitates (nm) | Density of precipitates (per 250000 $nm^2$) | Residual austenite (volume fraction %) | Remarks |
|---|---|---|---|---|---|---|---|---|---|---|---|---|---|---|
| 38 | T | 50 | 1050 | 850 | 150 | 120 | 520 | 15.0 | 0 | 0.3 | 2 | 75 | 1.5 | Example of the invention |
| 39 | U | 60 | 1200 | 850 | 150 | 120 | 500 | 3.0 | 60 | 0.3 | 3 | 53 | 0.5 | Example of the invention |

Note 1:
A mark * shows the value is out of the range of the invention.
However, a mark " in a column of residual austenite shows the value is out of the invention according to claim 7.
Note 2:
Average grain size (–) shows Mo, Nb, V or Ti based precipitates do not exist.

TABLE 3

| No. | Steel type | Thickness (mm) | Yield strength (Mpa) | Tensile strength (MPa) | vTrs at central portion in thickness (° C.) | Amount of critical diffusible hydrogen (mass ppm) | Remarks |
|---|---|---|---|---|---|---|---|
| 1 | A | 10 | 595 | 672 | −120 | 2.35 | Example of the invention |
| 2 | B | 25 | 601 | 685 | −126 | 1.69 | Example of the invention |
| 3 | C | 25 | 821 | 870 | −91 | 1.33 | Example of the invention |
| 4 | D | 25 | 1023 | 1046 | −83 | 1.01 | Example of the invention |
| 5 | E | 25 | 1011 | 1039 | −88 | 0.89 | Example of the invention |
| 6 | F | 12 | 1098 | 1120 | −71 | 0.75 | Example of the invention |
| 7 | G | 25 | 1067 | 1097 | −75 | 0.69 | Example of the invention |
| 8 | H | 50 | 1011 | 1034 | −76 | 0.66 | Example of the invention |
| 9 | I | 12 | 1352 | 1378 | −59 | 0.69 | Example of the invention |
| 10 | J | 25 | 1335 | 1350 | −55 | 0.53 | Example of the invention |
| 11 | K | 50 | 1295 | 1311 | −51 | 0.52 | Example of the invention |
| 12 | L | 25 | 1492 | 1522 | −39 | 0.48 | Example of the invention |
| 13 | G | 6 | 1292 | 1310 | −68 | 0.66 | Example of the invention |
| 14 | I | 12 | 1413 | 1423 | −55 | 0.63 | Example of the invention |
| 15 | J | 25 | 1398 | 1411 | −51 | 0.50 | Example of the invention |
| 16 | K | 60 | 1326 | 1342 | −43 | 0.50 | Example of the invention |
| 17 | M | 25 | 815 | 869 | −67 | 0.26* | Comparative example |
| 18 | N | 25 | 1000 | 1019 | −56 | 0.19* | Comparative example |
| 19 | O | 25 | 1093 | 1112 | −43 | 0.26* | Comparative example |
| 20 | P | 25 | 1308 | 1368 | −17 | 0.15* | Comparative example |
| 21 | A | 10 | 541 | 619 | −135 | 0.26* | Comparative example |
| 22 | B | 25 | 517 | 591 | −145 | 0.29* | Comparative example |
| 23 | C | 25 | 810 | 862 | −65 | 0.24* | Comparative example |
| 24 | D | 25 | 1011 | 1036 | −52 | 0.23* | Comparative example |
| 25 | E | 25 | 1005 | 1029 | −51 | 0.15* | Comparative example |
| 26 | F | 12 | 1121 | 1136 | −43 | 0.19* | Comparative example |
| 27 | G | 25 | 1083 | 1103 | −38 | 0.16* | Comparative example |
| 28 | H | 50 | 1011 | 1028 | −36 | 0.09* | Comparative example |
| 29 | I | 12 | 1351 | 1369 | −29 | 0.14* | Comparative example |
| 30 | J | 25 | 1332 | 1362 | −24 | 0.11* | Comparative example |
| 31 | K | 50 | 1287 | 1305 | −26 | 0.16* | Comparative example |
| 32 | L | 25 | 1453 | 1516 | −18 | 0.05* | Comparative example |
| 33 | Q | 25 | 970 | 1180 | −98 | 2.56 | Example of the invention |
| 34 | R | 30 | 1000 | 1210 | −88 | 2.10 | Example of the invention |
| 35 | S | 35 | 1150 | 1350 | −75 | 1.48 | Example of the invention |
| 36 | S | 35 | 1215 | 1388 | −77 | 1.85 | Example of the invention |
| 37 | T | 50 | 1250 | 1480 | −78 | 1.44 | Example of the invention |
| 38 | T | 50 | 1300 | 1450 | −78 | 1.99 | Example of the invention |
| 39 | U | 60 | 1320 | 1460 | −86 | 1.56 | Example of the invention |

Note
A mark * shows the value is out of the range of the invention.

TABLE 4

(mass %)

| Steel type | C | Si | Mn | P | S | Cu | Ni | Cr | Mo | Nb | V |
|---|---|---|---|---|---|---|---|---|---|---|---|
| Q | 0.09 | 0.20 | 1.35 | 0.005 | 0.0018 | 0.00 | 0.00 | 0.35 | 0.25 | 0.022 | 0.050 |
| R | 0.07 | 0.22 | 1.45 | 0.015 | 0.0010 | 0.00 | 0.00 | 0.35 | 0.21 | 0.015 | 0.035 |
| S | 0.13 | 0.35 | 1.75 | 0.004 | 0.0007 | 0.20 | 0.20 | 0.45 | 0.30 | 0.019 | 0.008 |
| T | 0.16 | 0.26 | 1.35 | 0.014 | 0.0012 | 0.02 | 0.00 | 0.55 | 0.26 | 0.020 | 0.041 |
| U | 0.19 | 0.45 | 1.52 | 0.018 | 0.0015 | 0.02 | 0.30 | 0.45 | 0.45 | 0.020 | 0.000 |

| Steel type | Ti | B | Ca | REM | Mg | Al | T.N | $Ar_3$ (° C.) | Remarks |
|---|---|---|---|---|---|---|---|---|---|
| Q | 0.000 | 0.0000 | 0.00 | 0.0014 | 0.031 | 0.0032 | 0.0012 | 0.43 | Example of the invention |
| R | 0.000 | 0.0000 | 0.00 | 0.0017 | 0.028 | 0.0029 | 0.0022 | 0.65 | Example of the invention |
| S | 0.010 | 0.0010 | 0.20 | 0.0012 | 0.022 | 0.0037 | 0.0015 | 0.80 | Example of the invention |
| T | 0.012 | 0.0012 | 0.00 | 0.0015 | 0.030 | 0.0030 | 0.0013 | 0.68 | Example of the invention |
| U | 0.010 | 0.0013 | 0.15 | 0.0020 | 0.027 | 0.0031 | 0.0020 | 0.60 | Example of the invention |

As clear from Table 3, in steel sheets Nos. 1 to 16 manufactured by the method of the invention (examples of the invention), in which the chemical composition, manufacturing method, precipitation pattern of precipitates, or volume fraction of residual austenite is within a range of the invention, high amount of critical diffusible hydrogen was able to be obtained. Furthermore, in steel sheets Nos. 33 to 39 (examples of the invention), in which ACR is within a range of the invention, comparatively higher amount of critical diffusible hydrogen was able to be obtained.

On the contrary, in comparative steel sheets Nos. 17 to 32 (comparative examples), the amount of critical diffusible hydrogen is out of the objective range. Hereinafter, the comparative examples are individually described.

In steel sheets Nos. 17 to 20, in which each composition is out of the range of the invention, both of the density of precipitates and the volume fraction of residual austenite are out of the range of the invention, and the amount of critical diffusible hydrogen does not reach to the objective value.

In a steel sheet No. 21, in which direct quenching start temperature is out of the range of the invention, both of the density of precipitates and the volume fraction of residual austenite are out of the range of the invention, and the amount of critical diffusible hydrogen does not reach to the objective value.

In a steel sheet No. 22, in which direct quenching stop temperature is out of the range of the invention, both of the density of precipitates and the volume fraction of residual austenite are out of the range of the invention, and the amount of critical diffusible hydrogen does not reach to the objective value.

In steel sheets Nos. 23 to 32, in which each average heating rate at a central portion of a steel material from a tempering start temperature to a predetermined tempering temperature is out of the range of the invention, numeral values of any two among the average grain size of precipitates, density of the precipitates, and volume fraction of residual austenite are out of the range of the invention, and the amount of critical diffusible hydrogen does not reach to the objective value.

INDUSTRIAL APPLICABILITY

According to the invention, a high tensile strength steel material having an extremely excellent, delayed fracture resistance property, of which tensile strength is 600 MPa or more, and particularly 900 MPa or more, can be manufactured, which is industrially extremely useful.

The invention claimed is:

1. A high tensile strength steel material having a tensile strength of at least 900 Mpa and having an excellent delayed fracture resistance property, comprising:

elements of, in mass percent, C of 0.02 to 0.25%, Si of 0.01 to 0.8%, Mn of 0.5 to 2.0%, Al of 0.005 to 0.1%, Mo of 0.2 to 1%, Cr of 0.3 to 2%, N of 0.0005 to 0.008%, P of 0.03% or less, $0.0004\% \leq S \leq 0.0025\%$, $0.0010\% \leq Ca \leq 0.0030\%$, and $0.0008\% \leq O \leq 0.0030\%$, and optionally at least one element selected from Nb of 0.001 to 0.1%, V of 0.001 to 0.5%, and Ti of 0.001 to 0.1%, in mass percent, and a value of ACR which satisfies the following expression $0.2 \leq ACR \leq 1.0$, and the remainder including Fe and inevitable impurities, and the microstructure of said steel material comprises martensite or bainite, [includes residual austenite in a volume fraction of 0.5 to 5%,] and precipitates contained in said steel include those of Mo and optionally of at least one element selected from Nb, V and Ti, an average grain size of said precipitates is 20 nm or less, and the number of said precipitates is at least 5 per 250000 $nm^2$, and $$ACR=(Ca-(0.18+130*Ca)*O)/1.25/S,$$

wherein Ca, O or S is the content (mass percent) of each component; and said high tensile strength steel material having an excellent delayed fracture resistance property is manufactured by a method comprising:

a step of quenching said steel material from a temperature of Ar3 transformation temperature or higher to a temperature of 500° C. or less, and a step of tempering the steel material while a central portion of the steel material is heated from a tempering start temperature to a predetermined tempering temperature at an average heating rate of 1° C./s or more, after the quenching.

2. The high tensile strength steel material having an excellent delayed fracture resistance property according to claim 1, further comprising:

at least one element selected from Cu of 2% or less, Ni of 4% or less, and W of 2% or less, in mass percent.

3. The high tensile strength steel material having an excellent delayed fracture resistance property according to claim 2, further comprising at least one element selected from B of 0.003% or less, REM of 0.02% or less, and Mg of 0.01% or less, in mass percent.

4. The high tensile strength steel material having an excellent delayed fracture resistance property according to claim 1, further comprising at least one element selected from B of 0.003% or less, REM of 0.02% or less, and Mg of 0.01% or less, in mass percent.

5. A method of manufacturing the high tensile strength steel material having an excellent delayed fracture resistance property according to claim 1, comprising:

a step of quenching the steel material from a temperature of Ar3 transformation temperature or higher to a temperature of 500° C. or less, and a step of tempering the steel material while a central portion of the steel material is heated from a tempering start temperature to a predetermined tempering temperature at an average heating rate of 1° C./s or more, after the quenching.

6. A method of manufacturing the high tensile strength steel material having an excellent delayed fracture resistance property according to claim 2, comprising:

a step of quenching the steel material from a temperature of Ar3 transformation temperature or higher to a temperature of 500° C. or less, and a step of tempering the steel material while a central portion of the steel material is heated from a tempering start temperature to a predetermined tempering temperature at an average heating rate of 1° C./s or more, after the quenching.

7. A method of manufacturing the high tensile strength steel material having an excellent delayed fracture resistance property according to claim 4, comprising:

a step of quenching the steel material from a temperature of Ar3 transformation temperature or higher to a temperature of 500° C. or less, and a step of tempering the steel material while a central portion of the steel material is heated from a tempering start temperature to a predetermined tempering temperature at an average heating rate of 1° C./s or more, after the quenching.

8. A method of manufacturing the high tensile strength steel material having an excellent delayed fracture resistance property according to claim 3, comprising:

a step of quenching the steel material from a temperature of Ar3 transformation temperature or higher to a temperature of 500° C. or less, and a step of tempering the steel material while a central portion of the steel material is heated from a tempering start temperature to a predetermined tempering temperature at an average heating rate of 1° C./s or more, after the quenching.

* * * * *